United States Patent [19]

Saikkonen

[11] Patent Number: 4,464,344

[45] Date of Patent: Aug. 7, 1984

[54] PROCESS FOR RECOVERING NON-FERROUS METAL VALUES FROM ORES, CONCENTRATES, OXIDIC ROASTING PRODUCTS OR SLAGS

[76] Inventor: Pekka J. Saikkonen, Alakartanontie 4 B 63, 02360 Espoo 36, Finland

[21] Appl. No.: 278,584

[22] PCT Filed: Nov. 20, 1980

[86] PCT No.: PCT/FI80/00008

§ 371 Date: Jun. 29, 1981

§ 102(e) Date: Jun. 29, 1981

[87] PCT Pub. No.: WO81/01420

PCT Pub. Date: May 28, 1981

[30] Foreign Application Priority Data

Nov. 22, 1979 [FI] Finland ..... 791684

[51] Int. Cl.[3] ..... C01G 1/10; C01F 15/00; C22B 1/06

[52] U.S. Cl. ..... 423/5; 423/21.1; 423/45; 423/49; 423/99; 423/111; 423/138; 423/155; 423/557; 423/3; 75/1 R; 75/116

[58] Field of Search ..... 423/3, 45, 557, 5, 21.1, 423/49, 99, 111, 138, 155, 548; 75/116, 1 R

[56] References Cited

U.S. PATENT DOCUMENTS

| | | | |
|---|---|---|---|
| 1,063,629 | 6/1913 | Wedge | 423/45 |
| 1,376,025 | 4/1921 | Middleton | 423/45 |
| 1,834,960 | 12/1931 | Mitchell | 75/1 R |
| 1,943,334 | 1/1934 | Mitchell | 75/1 R |
| 2,719,082 | 9/1955 | Sproule et al. | 75/1 R |
| 3,152,862 | 10/1964 | Fischer | 423/3 |
| 3,230,071 | 1/1966 | Marvin | 423/99 X |
| 3,761,563 | 9/1973 | Kaiser et al. | 423/5 |
| 3,910,784 | 10/1975 | Rastas | 75/1 R |
| 4,110,106 | 8/1978 | Frankiewicz | 75/1 R |
| 4,125,588 | 11/1978 | Hansen et al. | 423/155 X |

FOREIGN PATENT DOCUMENTS

| | | |
|---|---|---|
| 892475 | 2/1972 | Canada . |
| 977555 | 11/1974 | Canada . |
| 429582 | 7/1934 | United Kingdom . |
| 996472 | 6/1965 | United Kingdom . |

OTHER PUBLICATIONS

Rastas, et al., "Treatment of Iron Residues in the Electrolytic Zinc Process", TMS-AIME Paper No. A7-3-11.

CIM Bulletin, Apr. 1975, p. 71-83.

*Primary Examiner*—Deborah L. Kyle
*Assistant Examiner*—Matthew A. Thexton
*Attorney, Agent, or Firm*—Fitch, Even, Tabin & Flannery

[57] ABSTRACT

A process for recovering non-ferrous metal values from their ores, minerals, concentrates, oxidic roasting products, or slags by sulphating said starting material using a mixture comprising iron (III) sulphate and alkali metal- or ammonium sulphate as a reagent.

8 Claims, 3 Drawing Figures

Figure 1:
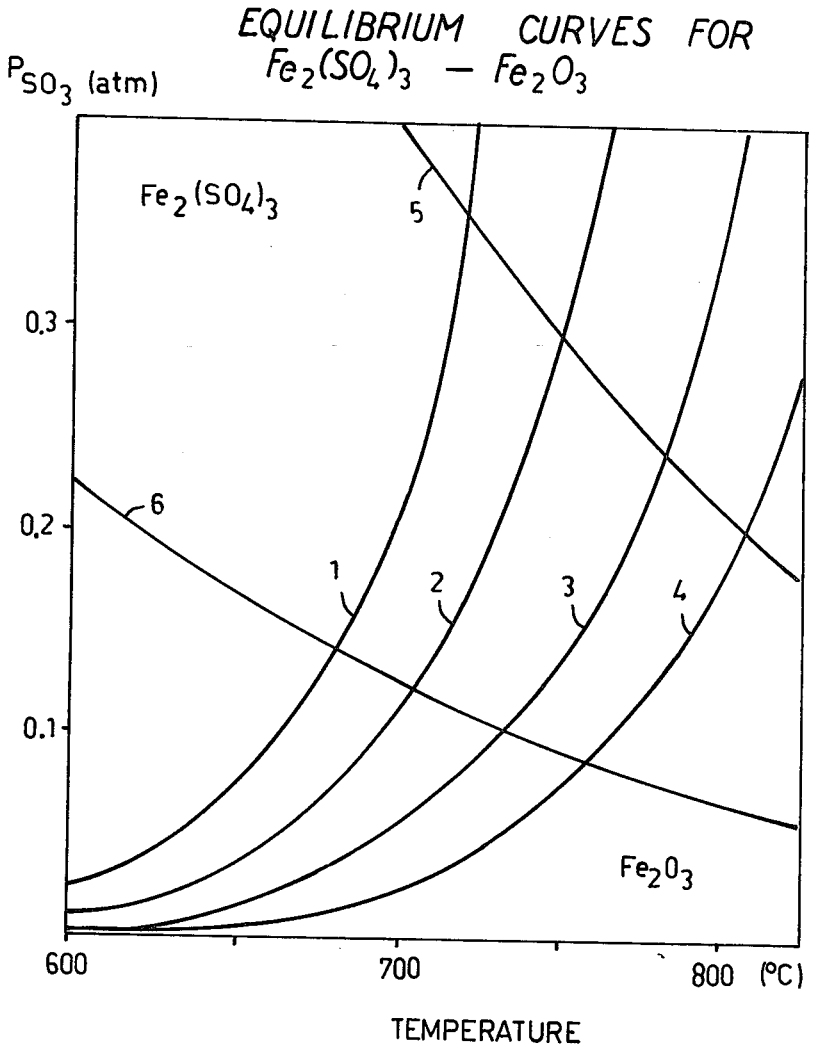

PROCESS FOR RECOVERING NON-FERROUS METAL VALUES FROM ORES, CONCENTRATES, OXIDIC ROASTING PRODUCTS OR SLAGS

A process for recovering non-ferrous metal values from ores, concentrates, oxidic roasting products or slags.

The present invention relates to a process for recovering non-ferrous metal values from ores, concentrates, oxidic roasting products, or slags by converting them into sulphates by using principally mixture of solid matters and molten salts as the sulphating agent. Said sulphating agent consists of alkali metal sulphate and iron (III) sulphate and one or more preferred non-ferrous metal sulphates.

The process described in this invention thus relates to a method that is widely used by the metallurgical industry for converting selectively particular non-ferrous metal values, which will be referred to as Me in the text, into their sulphates. These sulphates can then be separated from the tailings and in soluble hematite by a simple water leaching procedure. The non-ferrous values in the solution can thereafter be recovered by method known per se.

However, the known method, i.e. the sulphating roasting, involves some disadvantages which have often made it unfeasible for more extensive use. The main disadvantages have been difficulties in controlling reaction conditions, such as the $SO_3$ partial pressure and temperature, so that it is practically impossible to achieve the maximum yield of the wanted water-soluble metal sulphate and, simultaneously, the maximum conversion of iron to non-soluble hematite in a reasonable reaction time, and further on, to avoid the thermodynamically and, especially in higher temperatures, also kinetically favourable conversion reaction between hematite and said metal oxide into the ferrites. Another serious disadvantage is the forming of a sulphate layer on the reacting particle which, in certain cases, strongly affects the reaction rate.

In general, it is presently believed that during the course of the roast, the metal value Me is converted first into the oxide form in the following manner:

$$MeS + 3/2O_2 \rightarrow MeO + SO_2 \quad (1)$$

$$SO_2 + \tfrac{1}{2}O_2 \rightleftarrows SO_3 \quad (2)$$

$$MeO + SO_3 \rightleftarrows MeSO_4 \quad (3)$$

Thus in the reacting particle, there are simultaneously present the oxide of the wanted metal value MeO and the iron oxide $Fe_2O_3$. Thus, there are prerequisites for the ferrite formation, in other words for the reaction:

$$MeO + Fe_2O_3 \rightarrow MeFe_2O_4 \quad (4)$$

In general, it has been shown that all the sulphation reactions have occurred through the sulphate shell which has grown on the surface of the MeO particle during the course of the sulphation. It is through this shell that the reacting ions have to migrate before they can react further. The solid-state diffusion is, as well-known, a very slow phenomenon, especially when the migrating ionic species is large, such as an oxygen ion (see, for example, W. Jost and K. Hauffe: Diffusion. 2nd ed. Steinkopf Verlag, Darmstadt, 1972). On the other hand, the aforesaid formation reaction of ferrites is also a solid-state reaction when the oxides are diffusing into each other by counterdiffusion mechanism. The latter phenomenon is often considerably faster than the sulphation reaction. A commonly believed explanation for this is that in the ferrite formation reaction, only those ionic species with small dimensions (for example, metal ions) are migrating into each other in a relatively loose-packed oxygen lattice (see, for example, K. Hauffe: Reaktionen in und an der festen Stoffen, Springer Verlag, Berlin, 1955, p. 582 and H. Schmalzried: Solid State Reactions, Verlag Chemie, Weinheim, 1954, p. 90).

As the most important argument in favour of the previous review remains the experimental fact that from the competing reactions involving the Me-oxide, that is the reactions (3) and (4), reaction (4) occurs when there are thermodynamically favourable conditions, while the sulphation reaction (3) is normally very slow because it requires the diffusional migration of the reacting species through the growing sulphate shell.

It is well-known that, for example, the sulphation of nickel compounds is very difficult to perform because of the nonporous sulphate shell which does not offer any new reaction paths for the gas phase, for example, in the form of cracks or pores. It has been experimentally observed that the nonsulphated nickel has been mainly in the form of ferrite. Thus, the prior art of the sulphation can be described shortly:

When performing sulphating roasting with gaseous reagents ($O_2$, $SO_2$), it is impossible to avoid the formation of ferrites if one wants to operate under reaction conditions where iron and the wanted metal value Me are to be selectively partitioned.

Attempts have been made to eliminate these aforementioned disadvantages which characteristically occur in the gas phase sulphation by means of a very accurate control of the gas atmosphere and temperature, for example, with the aid of a fluid-bed reactor or, on the other hand, by using some additives.

Thus, the Finnish Pat. No. 31124 discloses that the yield of the metal values, such as Cu, Co, Ni and Zn, may be increased by sulphating roasting the concentrates with the addition of small amounts of inorganic chloride, e.g., NaCl or $CaCl_2$. Accordingly, in the U.S. Pat. No. 3,442,403 gaseous HCl is used for the same purpose. Further, U.S. Pat. No. 2,813,016 discloses a process for sulphating roasting which utilizes sodium sulphate $Na_2SO_4$ as an additive. It is proposed that sodium sulphate reacts with gaseous $SO_3$ and forms Na-pyrosulphate $Na_2S_2O_7$ which is commonly known as a very effective liquid state sulphating agent:

$$Na_2SO + SO_3 \rightleftarrows Na_2S_2O_7 \quad (5)$$

The formation of pyrosulphate according to reaction (5) is also the basis of a process described in U.S. Pat. No. 4,110,106 in which the reaction mixture consists of potassium and sodium sulphates. Pyrosulphate has long been known from literature as a sulphating agent (see, for example, Ingraham et al. Can Met Quart. 5 (1965) no 3 p. 237–244. Can Met Quart 7 (1968) no 4 p. 201–204 and 205–210). The promoting effect of $Na_2SO_4$ in the sulphating roasting has been discovered as early as 1905 by N. V. Hybinette (German Pat. No. 200372).

The common factors for the above processes are that the reagent effective in sulphation is sulphur trioxide present in the gas phase and that the aim is to obtain selective sulphation, that is, reactions are performed under such reaction conditions that $Fe_2(SO_4)_3$ decomposes while yielding hematite $Fe_2O_3$. These reaction conditions are, according to the thermodynamics of the Fe--S—O system, dependent upon the partial pressure of the $SO_3$ gas and the temperature of the reacting system so that the temperature with the usually used $SO_3$ pressures is above 650°-675° C. (see FIG. 1). The process according to the present invention differs from the above in that the reagent used for sulphatation is principally the iron (III) sulphate which is added to the reaction mixture and in that the operation is carried out in such a temperature range that this reagent ($Fe_2(SO_4)_3$) forms a stable phase, either alone or together with a salt melt.

In accordance with the present invention, the reaction is carried out under oxidizing conditions in a temperature range of 400° C.-800° C., preferably 600° C.-800° C., and most preferably 600° C.-700° C.

On the basis of the foregoing, it can be claimed that there are at least two ways to influence the two competing reactions, i.e. the ferrite formation reaction (4) and the sulphate formation reaction (3). They can be used together or separately as follows:

(a) by operating under conditions where $Fe_2O_3$ is not stable and thus the ferrite formation reaction is totally prevented, or (b) by assuring that the relative rate of the sulphatation reaction is promoted by removing the barring, sulphate shell when it is formed.

Conventional sulphating roasting with gaseous reagents in practice offers no possibility to operate either according to solution (a) or (b). The situation is quite different when utilizing the characteristics of the melt phase consisting of the ternary system of certain sulphates. $A_2SO_4$—$Fe_2(SO_4)_3$—$MeSO_4$ is a ternary system where A is an alkali metal ion (usually sodium or potassium) or the $NH_4^+$ ion.

First the fundamentals of the process according to the present invention will be discussed. In the text, reference is made to the drawings and tables as follows:

FIG. 1 is a graph showing the stability diagram of the system $Fe_2(SO_4)_3$—$Fe_2O_3$ with the temperature and the partial pressure of $SO_3$ in the gas atmosphere as variables. The diagram shows the equilibrium curves for iron(III)sulphate with activities of 1, 0.1, 0.01 and 0.001, respectively (curves 1-4). There is also shown an equilibrium curve for $SO_3/SO_2$ (maximum $SO_3$ content at a pressure of 1 bar) when the initial mixture contains pure $O_2$ and $SO_2$ in stoichiometric relation (curve 5) and when the initial mixture consists of technical air and $SO_2$ in stoichiometric relation, i.e. $SO_2$:$O_2$=2:1 (curve 6).

Figure 2:
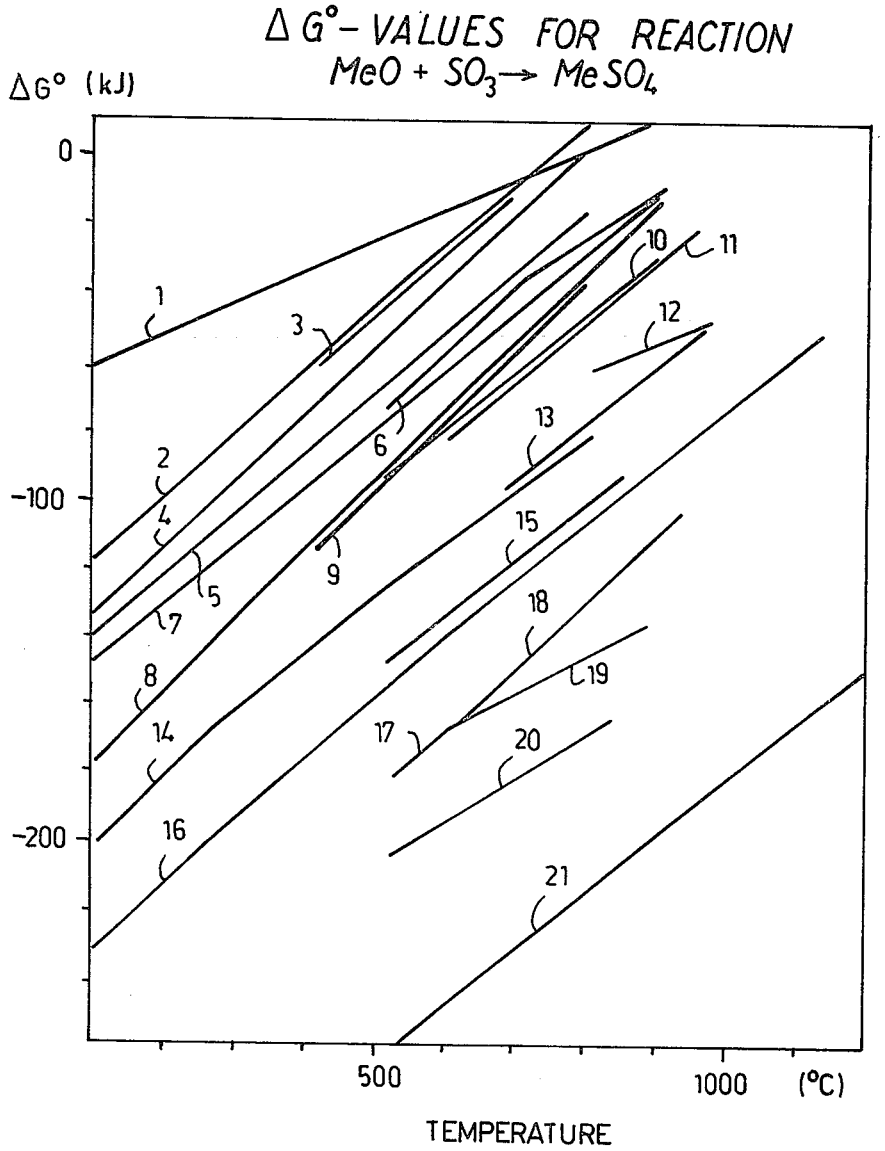

FIG. 2 and the associated table 1 show the values of the molar Gibbs energy (known earlier as the free energy) with respect to temperature for the reaction $$MeO+SO_3 \rightarrow MeSO_4 \quad (6)$$

calculated for one reacting $SO_3$ mole.

The technically most important known reactions for which reliable thermodynamical values are available are compiled in FIG. 2 and Table 1.

TABLE 1

| Equilibrium reactions of different metal sulfates as in FIG. 2 |
|---|
| 1 $SO_2 + \frac{1}{2} O_2 = SO_3$ |
| 2 $\frac{1}{3} Al_2O_3 + SO_3 = \frac{1}{3} Al_2(SO_4)_3$ |
| 3 $\frac{1}{3} Fe_2O_3 + SO_3 = \frac{1}{3} Fe_2(SO_4)_3$ |
| 4 $BeO + SO_3 = BeSO_4$ |

TABLE 1-continued

| Equilibrium reactions of different metal sulfates as in FIG. 2 |
|---|
| 5 $CuO.CuSO_4 + SO_3 = 2\ CuSO_4$ |
| 6 $ZnO.2\ ZnSO_4 + SO_3 = 3\ ZnSO_3(\beta)$ |
| 7 $2\ CuO + SO_3 = CuO.CuSO_4$ |
| 8 $NiO + SO_3 = NiSO_4$ |
| 9 $\frac{1}{2} ThO_2 + SO_3 = \frac{1}{2} Th(SO_4)_2$ |
| 10 $3/2\ ZnO + SO_3 = \frac{1}{2} (ZnO.2\ ZnSO_4)$ |
| 11 $CoO + SO_3 = CoSO_4$ |
| 12 $\frac{1}{2} (CdSO_4.2\ CdO) + SO_3 = 3/2\ CdSO_4$ |
| 13 $\frac{1}{2} (La_2O_3.SO_3) + SO_3 = \frac{1}{2} La_2(SO_4)_3$ |
| 14 $MnO + SO_3 = MnSO_4$ |
| 15 $PbSO_4.PbO + SO_3 = 2\ PbSO_4$ |
| 16 $MgO + SO_3 = MgSO_4$ |
| 17 $3/2\ (PbSO_4.4\ PbO) + SO_3 = 5/3\ (PbSO_4.2\ PbO)$ |
| 18 $2\ (PbSO_4.2\ PbO) + SO_3 = 3\ (PbSO_4.PbO)$ |
| 19 $3/2\ (PbSO_4.4\ PbO) + SO_3 = 5/2\ (PbSO_4.2\ PbO)$ |
| 20 $5\ PbO + SO_3 = PbSO_4.4\ PbO$ |
| 21 $CaO + SO_3 = CaSO_4$ |

Unfortunately, for some of the metals which this invention concerns, the available data about required thermodynamic values are insufficient to calculate similar curves as presented in FIG. 2. Thus, for example, it can be supposed that the appropriate curve for uranium is located between curves 14 and 16. Accordingly, the appropriate curve for cerium is located between curves 7 and 9. The equilibrium reactions connected with FIG. 2 are described in Table 1. The reactions of Table 1 and the respective $\Delta G°$ values from FIG. 2 are to be combined, and thus it is easy to calculate the thermodynamic prerequisites for the reactions (8) under different temperatures.

Figure 3:
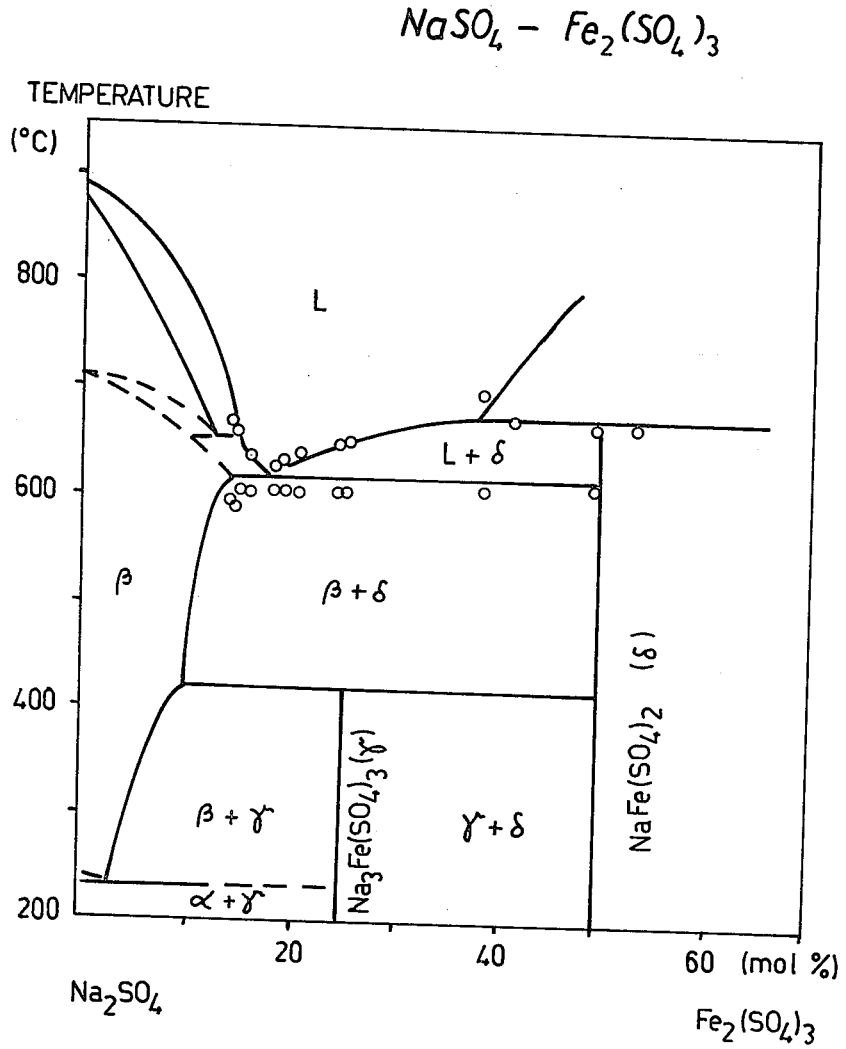

FIG. 3 contains a phase diagram of the system $Na_2SO_4$—$Fe_2(SO_4)_3$ according to the measurements made by the author and according to P. I. Fedorov and N. I. Illina: Russ. J. of Inorg. Chem. 8 (1963) p. 1351.

The mechanism of the sulfation according to the present invention is as follows:

When heating in oxidizing conditions, e.g. in air, the mixture that contains some compound (usually sulfide) of the wanted metal and the Na-rich mixture of the binary partial system of the beforesaid ternary system (as an example, the system $Na_2SO_4$—$Fe_2(SO_4)_3$ can be into consideration) to 605° C., a small amount of the eutectic melt of the system $Na_2SO_4$—$Fe_2(SO_4)_3$ begins to form. In the beginning, the melt contains 17 mole percent $Fe_2(SO_4)_3$. When it is heated to higher temperatures, the amount of the liquid phase in the mixture increases and it is able to dissolve the Me-oxide which is formed by the reaction with atmospheric oxygen (and it also dissolves the minor amount of Me-sulphate which is probably formed). If the starting material consists of the incongruently melting compound $NaFe(SO_4)_2$, which is also included in said binary system, it forms a melt phase at the temperature 680° C. which contains about 40 percent $Fe_2(SO_4)_3$ and, at the same time, the pure $Fe_2(SO_4)_3$ precipitates. It has now an activity value of 1 and it shows a strong tendency to decompose in conditions according to FIG. 1, curve 1, if that tendency is not obscured by a sufficient $SO_3$-pressure of the surrounding atmosphere. On the other hand, the amount of $Fe_2(SO_4)_3$, which is already present in the liquid phase, remains essentially unaffected because of the favourable activity conditions.

At the same time as the amount of the third sulphate ($MeSO_4$) in the ternary $MeSO_4$—$Fe_2(SO_4)_3$—$Na_2SO_4$ mixture increases, the total amount of the liquid phase increases and thus also its ability to moisten the reaction mixture and to dissolve the formed reaction product MeO or $MeSO_4$ increases. If the reaction temperature is constant, the dissolving process is an autocatalytic one. It increases until the limiting factor is either the total amount of the dissolvable material or, in principle, the mixture becomes saturated with the dissolved salt $MeSO_4$ in which case the salt begins to precipitate.

It has been experimentally noticed that the formation of the liquid phase in the ternary $MeSO_4$—$Fe_2(SO_4)_3$—$Na_2SO_4$ system can also proceed as a reaction between solid materials below 605° C.

Although the text has been concerned only with ternary mixtures to illustrate the objects of the present invention, this should not in any way be construed as a limiting factor. Thus it is also an object of the present invention to extract metal values from complex concentrates containing several metals. It is also an object of the invention to use Na—K—Fe-sulphate as a starting material.

It should be particularly noted that the reactions of this type which are taking place in the melts of the ionic salts are extremely fast, because they are charge transfer reactions which are thus taking place between ionic constituents as follows:

$$3Me^{2+}+3O^{2-}+2Fe^{3+}+3SO_4^{2-}\rightarrow 3Me^{2+}+3SO_4^{2-}+Fe_2O_3 \quad (7)$$

As a consequence of the reaction, the produced hematite ($Fe_2O_3$) precipitates out of the melt because of its low solubility, whereas the wanted metal value Me remains in the melt as an ionic species and is recoverable with different methods.

When performing sulphation with the process of this invention, particular care must be taken that the amount of the iron(III)sulphate in the reaction mixture is sufficient to obtain a full conversion with respect to the wanted metal oxide or oxides according to reaction 7.

Thus, the iron(III)sulphate present in the reaction mixture should not be allowed to decompose unduly, at least before all the metal value Me is in the sulphated form. Its amount should be optimized by selecting the temperature and $SO_3$ pressure of the surrounding gas atmosphere in the known and controlled manner so that there is always enough iron(III)sulphate available for use according to reaction 7.

It should be particularly noted that the $SO_3$ content of the gas atmosphere has in principle no other role in the reactions than to keep the iron(III)sulphate stable in higher temperatures as is advantageous.

As a natural starting material for the application of the present invention, various sulphidic ores and concentrates can be used which nearly always contain also iron. Minerals present in such ores are typically pyrite, pyrrhotite, galena, sphalerite, pentlandite, chalcopyrite, cubanite, bornite, covellite and millerite. Thus, by performing the oxidation needed for the preliminary treatment in the controlled conditions and at low temperature, it is possible to get as a reaction product, a part of the existing iron and the wanted metal already in the sulphate form because they have reacted with the $SO_2$ and $SO_3$ released in the oxidation, while the rest of the wanted metal oxidizes is oxidized into the corresponding oxide. It should be particularly noted that, when oxidizing sulphidic material, the reaction is highly exothermic and the heat evolved easily causes local overheating. Table 2 shows the ignition points of various sulphide minerals.

TABLE 2

The ignition points of some pure sulphide minerals (F. Habashi: Chalcopyrite, its Chemistry and Metallurgy, McGraw-Hill Inc, Chatmam, 1978, p. 45)

| Particle size mm | Ignition temperature °C. Pyrite (53.4% S) | Pyrrhotite (36.4% S) | Chalcopyrite (34.5% S) | Sphalerite (32.9% S) | Galena (29.4% S) |
|---|---|---|---|---|---|
| 0.10–0.15 | 422 | 460 | 364 | 637 | 720 |
| 0.15–0.20 | 423 | 465 | 375 | 644 | 730 |
| 0.20–0.30 | 424 | 471 | 380 | 646 | 730 |
| 0.30–0.50 | 426 | 475 | 385 | 646 | 735 |
| 0.50–1.00 | 426 | 480 | 395 | 646 | 740 |
| 1.00–2.00 | 428 | 482 | 410 | 646 | 750 |

With the aid of thermal analysis it has been noted that the oxidation and conversion to sulphates progress at temperatures that are a little higher (50°–150° C.) than the ignition temperatures. Under these conditions, a considerable part of the iron and the wanted metal value is in the sulphate form, which is preferable both from the point of view of a much easier formation of the ternary melt and a smaller consumption of the iron(III) sulphate.

When oxidizing for example chalcopyrite in air atmosphere, it has been noted (F. Habashi:Calcopyrite, its Chemistry and Metallyrgy, McGraw-Hill Inc., Chatmam 1978, p. 51) that the amount of water-soluble copper has been 40–60% and iron 10–15% of the amount needed when operating at 500° C.

The described application of the process of this invention is not by any means considered to be limited only to sulphidic minerals or concentrates that contain iron. However, the application that is described does offer a convenient solution of the processing of iron-containing substances because the starting materials consist of reaction components such as the elements Fe, Me, S, and O, which are in a convenient form for the application of the process. Further, the appreciable heat of reaction when the sulphidic material oxidizes is a significant advantage for the heat economy of the process, and said heat can be used in other steps of the process.

When making a thermodynamic examination of the reaction (7) in component form (FIG. 2):

$$3MeO+Fe_2(SO_4)_3\rightarrow 3MeSO_4+Fe_2O_3 \quad (8)$$

it is observed that reaction (8) is thermodynamically favourable for most of the important metals. The most important exception is aluminium. Thus, referring to well-known thermodynamics and, on the other hand, to the remarkable higher speed of the ionic reactions in salt melts compared to the speed of solid state reactions, it can be supposed with good reason that the process is, with the exception of aluminium, applicable to the production of most of the metals of industrial significance when converting them from their oxide form to their sulfate form.

To what extent it is possible to use its sulfate form to extract a metal value Me by a simple water leaching procedure, depends in various cases on both the solubility of the metal sulfate in question, and also on the existing methods to remove the harmful substances, in this case especially iron, from the solution.

Recently, the method for the precipitation of iron(III) compounds as a jarosite compound from the mildly acidic solutions first described by Steinveit (Norwegian Pat. No. 108 047) has gained very wide use, especially in the zinc process industry. Another known method to precipitate iron is the so-called goethite process (Belgian Pat. No. 724 214, Australian Pat. No. 424 095).

There are several known jarosite compounds (Na, K and $NH_4$ jarosites) which are being used in industrial zinc processes. The jarosites form a series of compounds in which the alkali metal can be isomorphically substituted by another. Their chemical formula can be written in the general form:

$$A_x(H_3O)_{1-x}Fe_3(SO_4)_2(OH)_6$$

Thus, a part of the alkali-ions are isomorphically substituted by the $H_3O^+$ ion. This is the situation especially with sodium jarosite; usually at least 20% of the sodium has been substituted by the hydronium ion. On the contrary, in the case of potassium-jarosite, the amount of substitution is considerably less. The decomposition of the mixed jarosites proceeds as is schematically described in Table 3.

TABLE 3

Thermal decomposition of the jarosites

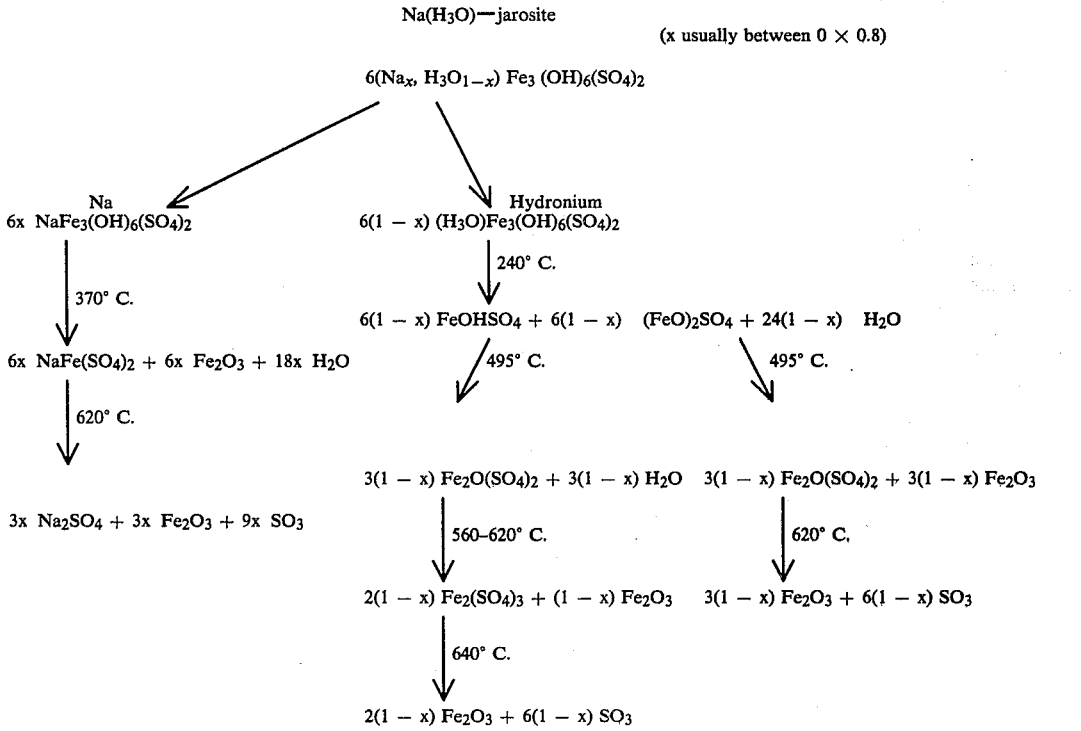

From Table 3, it is noted that, above the temperature 370° C., the aforementioned double sulfate with the general chemical formula $AFe(SO_4)_2$ is formed in the mixture. This kind of partly decomposed jarosite contains, in addition to said double sulfate, also different amounts of hematite $Fe_2O_3$ and ferric sulfate $Fe_2(SO_4)_3$, depending on the degree of the isomorphic substitution, and offers thus a particularly convenient starting material for the application of the process of the present invention by forming, as described, the impure double sulfate $AFe(SO_4)_2$ where symbol A represents one of the following ions or a combination of them: Na, K or $NH_4$. By using jarosite compounds as a starting material it is possible to reach situation where the alkali- and iron sulfates present in the process can, to a large extent, be recirculated and, by this means, the environmental problems that are typical of the jarosite process can be decreased and the cost of reagents can be reduced. The amount of hematite that is formed in the reaction mixture can be filtered by simple mechanical filtration before the jarosite precipitation and it can thus form a valuable by-product or an object of further processing. It is often an advisable procedure to thermally decompose the iron(III)sulfate before dissolving it, either in another part of the reactor or in a separate reactor. The formation of ferrites can thus be avoided beacuse the metal values already exist in the sulfate form and it is much easier to control the temperature because the reactions, in this case, are not exotermic.

The recovery of metals by first converting them into sulfates has been applied or suggested for application to the following metals: copper, cobolt, nickel, zinc, manganese, beryllium, uranium, thorium, cadmium, magnesium and to rare earth metals such as lanthanium, cerium etc. On the basis the thermodynamic examination, it can be stated that all of the aforementioned metals come into consideration when applying the process of the present invention. All of them also form a sulphate which dissolves sufficiently in water.

Thus, a natural starting material for the application of the process in question consists of the sulphides or oxides of the aforementioned metals or of materials which are easily converted into the sulphidic or oxidic form. Also the ferrites of different metals can succesfully be handled according to the present invention. Further, it is directly applicable to some silicates, carbonates and phosphates, either as such or combined with oxidizing or sulphatizing treatment.

The invention will be further understood from the following examples which should not in any way be construed as limiting.

EXAMPLE 1

To solve the usable operating conditions with different starting materials, a series of experiments were carried out with copper concentrate which contained copper as chalcopyrite. The analysis of the concentrate was 28.0 percent Cu and 3.8 percent Zn. The experiments were carried out with Na—$H_3O$-jarosite which contained 0.8 mol of Na, or with Na—K-jarosite which contained 0.43 mol of Na and 0.37 mol of K (per mole of the jarosite compound), or with a synthetically prepared compound $NaFe(SO_4)_2$ as the sulphate donating agent. The experiments were performed in a conventional laboratory furnace in open crucibles and in air atmosphere. The results were as follows:

| Temperature °C. | Time min | Compound | Mixture ratio concentrate/ sulphate mg/mg | Yield/% water-soluble Cu | Zn |
|---|---|---|---|---|---|
| 700 | 5 | $NaFe(SO_4)_2$ | 200/400 | 67 | |
| 660 | 16 | " | 200/600 | 73 | |
| 620 | 37 | " | 100/600 | 100 | 95 |
| 620 | 37 | Na—jarosite | 100/800 | 100 | |
| 580 | 30 | Na—jarosite | 200/300 | 92 | |
| 560 | 60 | Na—K—jarosite | 200/350 | 99 | 97 |
| 560 | 37 | $NaFe(SO_4)_2$ | 200/300 | 94 | |
| 600/560 | 8/52 | " | 200/150 | 96 | |
| 600/560 | 8/52 | Na—jarosite | 200/300 | 96 | |
| 600/560 | 8/52 | " | 500/500 | 98 | 97 |
| 520 | 60 | Na—K—jarosite | 200/300 | 92 | |

EXAMPLE 2

The same concentrate was used as in example 1 except that the $SO_2$-content was increased and the $O_2$-content decreased by covering the crucibles with lids. The following results were noted:

| Temperature °C. | Time min | Compound | Mixture/ratio | Yield/% water-soluble Cu |
|---|---|---|---|---|
| 650 | 30 | $NaFe(SO_4)_2$ | 200/300 | 63 |
| 650 | 30 | " | 200/300 | 57 |

An experiment was also performed where 200 mg of the concentrate together with 300 mg of $NaFe(SO_4)_2$ were closed in an autoclave. It turned out that, after a reaction period of 25 minutes, the material still was present mainly as a sulphide. Thus, it can be concluded that a sufficient availability of oxygen is one of the main requirements when performing sulphatation according to the present method.

EXAMPLE 3

A similar treatment as described in Examples 1 and 2 was carried out with several Co-concentrates containing between 18 and 20 mole percent Co. The following results were obtained:

| Temperature °C. | Time min | Compound | Mixture ratio | Yield/% water-soluble Co |
|---|---|---|---|---|
| 600/560 | 60 | Na—jarosite | 200/300 | 94 |

-continued

| Temperature °C. | Time min | Compound | Mixture ratio | Yield/% water-soluble Co |
|---|---|---|---|---|
| 580 | 30 | Na—jarosite | 200/300 | 91 |

EXAMPLE 4

A similar treatment as described in Examples 1 and 2 was performed with $Cu_2O$ and CoO in normal air atmosphere and by using the compound $Na_3Fe(SO_4)_2$ which is included in the $Na_2SO_4$—$Fe_2(SO_4)_3$-system. The following results were obtained:

| Temperature °C. | Time min | Compounds | Mixture ratio | Yield/% water-solubles |
|---|---|---|---|---|
| Cu | | | | |
| 630/560 | 20/40 | $Na_3Fe(SO_4)_2$ | 100/1000 | 100 |
| Co | | | | |
| 630/560 | 20/40 | $Na_3Fe(SO_4)_2$ | 100/1000 | 93 |

In other words, sulphation can be performed in the melt without any atmospheric sulphuric trioxide, as has been stated.

EXAMPLE 5

A melt was produced from K—Na- and Cu-sulphates with the molar ratios 1:1:1. 200 mg of $Fe_2O_3$ was added at 600° C. to this melt, and the mixture was treated for one hour. The amount of water-soluble iron which had reacted to form the sulphate was 0.6 mg. Thus, $Fe_2O_3$ is only very slightly soluble in the melt conditions in question.

EXAMPLE 6

A similar treatment as described in Examples 1, 2 and 5 was performed on the dumped slag of the slag concentration plant of a copper smelter. The analysis of the slag was 0.45 percent Cu, 3.5 percent Zn, 1.3 percent Mg and 0.82 percent Ca. The compounds were present mostly as silicates. The treatment was performed at 630° C. in air atmosphere, and the reaction time was one hour. The silicate-sulphate ratio in the mixture was 1:1. The following results were obtained:

| Temperature °C. | Time min | Compound | Yield (water-solubles %) Cu | Zn | Mg | Ca |
|---|---|---|---|---|---|---|
| 630 | 60 | $NaFe(SO_4)_2$ | 89 | 58 | 55 | 46 |
| 630 | 60 | $Na_3Fe(SO_4)_3$ | 78 | 71 | 52 | 41 |

It can be stated that the present method is applicable also to the siliceous slag which is a difficult material to treat economically with other methods, and that the present method is applicable also to low metal concentrations of the starting material.

EXAMPLE 7

A similar treatment as described in Examples 1, 2 5 and 6 was performed on a $Na_2SO_4$—$FeSO_4$-mixture (molar ratio 1:1) and the copper concentrate of Example 1. The temperature was 600° C., and the reaction time was one hour. The ratio of Cu-concentrate to sulphate was 200 mg/400 mg. The yield of the water-soluble copper was 93 percent.

I claim:

1. In a process for recovering nonferrous metal values selected from the group consisting of copper, cobalt, nickel, zinc, manganese, beryllium, uranium, thorium, cadmium, magnesium and the rare earth metals from starting material selected from the group consisting of ores, concentrates, oxidic roasting products, ferrites, and slags by converting said metal values to sulfates with the aid of thermal treatment under oxidizing conditions in the temperature range of 400°–800° C., the improvement which comprises (a) forming a reaction mixture of said starting material containing at least one of said metal values, iron(III)sulfate and another sulfate selected from the group consisting of alkali metal sulfate, ammonium sulfate, a compound containing said sulfates, and mixtures thereof, the molar ratio of iron(III)sulfate to the alkali metal sulfate in said reaction mixture being from about 0.1 to about 0.5, said alkali metal being selected from the group consisting of sodium, potassium, lithium and mixtures thereof, the total amount of said iron(III)sulfate being at least the stoichiometric amount needed to react with the metal value Me according to the reaction:

$$3MeO_{(melt+solid)}+Fe_2(SO_4)_{3(melt)}\rightarrow 3\,MeSO_{4(melt)}+Fe_2O_{3(solid)}$$

and (b) adjusting the temperature and the partial pressure of $SO_3$ in the gas atmosphere so that the thermal decomposition of said iron(III)sulfate in the melt according to the reaction $$Fe_2(SO_4)_{3(melt)}\rightarrow Fe_2O_{3(solid)}+3SO_{3(gas)}$$

is substantially prevented.

2. The process of claim 1 wherein said reaction mixture is reacted at a temperature between about 600° and about 800° C. in a $SO_3$-gas atmosphere of between about 0.03 and about 0.3 bar.

3. In a process for recovering nonferrous metal values selected from the group consisting of copper, cobalt, nickel, zinc, manganese, beryllium, uranium, thorium, cadmium, magnesium and the rare earth metals from starting material selected from the group consisting of ores, concentrates, oxidic roasting products, ferrites and slags by converting said metal values to sulfates with the aid of thermal treatment under oxidizing conditions in the temperature range of 600°–700° C., the improvement which comprises (a) forming a reaction mixture of the said starting material containing at least one of said metal values, iron(III)sulfate and another sulfate selected from the group consisting of alkali metal sulfate, ammonium sulfate, a compound containing said sulfates, and mixtures thereof, the molar ratio of iron(III)sulfate to the alkali metal sulfate in said reaction mixture being about 0.5, said alkali metal being selected from the group consisting of sodium, potassium, lithium and mixtures thereof, the total amount of said iron(III)sulfate being at least the stoichiometric amount needed to react with the metal value Me according to the reaction:

$$3MeO_{(melt+solid)}+Fe_2(SO_4)_{3(melt)}\rightarrow 3MeSO_{4(melt)}+Fe_2O_{3(solid)}$$

and (b) adjusting the temperature and the partial pressure of $SO_3$ in the gas atmosphere so that the thermal decomposition of said iron(III)sulfate in the melt according to the reaction $$Fe_2(SO_4)_{3(melt)}\rightarrow Fe_2O_{3(solid)}+3SO_{3(gas)}$$

is substantially prevented.

4. The process of claim 1 or 3 wherein said reaction mixture comprises ores, concentrates, roasted oxidic products, ferrites or slags of said metal values and a jarosite-type compound of the formula $$A[Fe_3(OH)_6(SO_4)_2]$$

where A is selected from the group consisting of sodium, potassium, ammonium and mixtures thereof.

5. The process of claim 1 or 3 wherein said reaction mixture comprises ore, concentrate, roasted oxidic product, ferrite or slag and double sulfate having the formula $AFe(SO_4)_2$ where A is selected from the group consisting of sodium, potassium, ammonium and mixtures thereof, which double sulfate is formed by thermal treatment of said jarosite compound.

6. The process of claim 1 or 3 wherein the iron(III)sulfate of said reaction mixture is formed at least partially from the iron compounds of the starting material by simultaneous or preceding thermal treatment under sulfating reaction conditions.

7. The process of claim 1 or 3 wherein after the sulfation reaction the iron(III)sulfate remaining in the reaction mixture is converted into hematite.

8. The process of claim 1 or 3 wherein the iron(III)sulfate remaining in the reaction mixture after the sulfation reaction is precipitated as a jarosite- or goethite-type compound.

* * * * *